US009770648B1

(12) United States Patent
Nelson et al.

(10) Patent No.: US 9,770,648 B1
(45) Date of Patent: Sep. 26, 2017

(54) CIRCUIT PUZZLE

(71) Applicants: Harry Lewis Nelson, Livermore, CA (US); Kevin Daniel Norman, El Sobrante, CA (US); Penelope Anne Norman, El Sobrante, CA (US); Hiroshi Yamamoto, Matto (JP)

(72) Inventors: Harry Lewis Nelson, Livermore, CA (US); Kevin Daniel Norman, El Sobrante, CA (US); Penelope Anne Norman, El Sobrante, CA (US); Hiroshi Yamamoto, Matto (JP)

( * ) Notice: Subject to any disclaimer, the term of this patent is extended or adjusted under 35 U.S.C. 154(b) by 952 days.

(21) Appl. No.: 13/694,446

(22) Filed: Dec. 3, 2012

Related U.S. Application Data

(60) Provisional application No. 61/630,192, filed on Dec. 5, 2011.

(51) Int. Cl.

| | |
|---|---|
| ***A63F 9/24*** | (2006.01) |
| ***A63F 13/00*** | (2014.01) |
| ***G06F 17/00*** | (2006.01) |
| ***G06F 19/00*** | (2011.01) |
| ***A63F 9/06*** | (2006.01) |

(52) U.S. Cl.
CPC ..... *A63F 9/0612* (2013.01)

(58) Field of Classification Search
USPC ..... 273/237, 238; 463/1, 9, 14, 20, 22, 25, 463/46
See application file for complete search history.

(56) References Cited

U.S. PATENT DOCUMENTS

| | | | | |
|---|---|---|---|---|
| 6,102,397 | A * | 8/2000 | Lee et al. | 273/238 |
| 2002/0111203 | A1* | 8/2002 | Chi | A63F 9/10 463/9 |
| 2009/0008875 | A1* | 1/2009 | Wu | A63F 9/10 273/153 S |
| 2009/0309303 | A1* | 12/2009 | Wallace et al. | 273/237 |
| 2011/0031689 | A1* | 2/2011 | Binder | 273/157 R |

* cited by examiner

*Primary Examiner* — Adetokunbo O Torimiro
(74) *Attorney, Agent, or Firm* — Risto A. Rinne, Jr.

(57) ABSTRACT

An apparatus for the creation of an electrical circuit on a game board as a puzzle to be solved, is provided. The game board includes an electrical control circuit that induces an electromagnetic field above a planar surface of the game board. A plurality of electrically conductive distinctly curved game pieces are placed in various ways on top of the planar surface, the goal being to place all of the pieces on the planar surface in a loop in order to create the electrical circuit. When the final game piece is placed, an induced current flow is experienced by the electrical circuit and detected by the electrical control circuit. In response to detecting completion of the electrical circuit, the electrical control circuit activates an audible indication and a visual indication simultaneously for a period of time to provide a pleasurable reward to the user in the form of sensory feedback.

17 Claims, 10 Drawing Sheets

Description of the Circuit Puzzle Game Program

INIT Initialize the processor hardware as required on power up

RESET Initialize game variables to their beginning state.

Check the power switch. If the switch is on go GAME INIT, otherwise go to SLEEP.

SLEEP Configure hardware for minimum power consumption and execute HALT instruction. The game on LED is turned off here.

GAME INIT Set variables used in game loop to initial state. The game on LED is turned on here.

GAME LOOP This loop is the heart of the program. It generates a continuous precise 400 kHz signal to drive the analog portion of the game solved detection circuit.

Interleaved with the signal generation code is code to:

Count the time that the game has been playing. When the maximum time has been reached the code exits and jumps to SLEEP.

Check to see if the switch has been turned off. If the switch has been turned off the code exits and jumps to RESET. (Could be SLEEP.)

Check to see if the game has been solved. If the game has been solved the code exits and jumps to VICTORY.

WAKEUP The processor hardware is configured to execute this code on the basis of specified external inputs, in this case the on switch and the try me switch. The wakeup code reconfigures the hardware for operation and checks the switch. If the switch is on the code jumps to RESET, otherwise it jumps to VICTORY. (If the switch is off the processor was awakened by the try me switch.)

VICTORY This is the code that plays the music and flashes the LEDs.

The VICTORY code sets up an interrupt program to play the music and a top level program which monitors the progress of the music playing and flashes the LEDs.

This code also monitors the state of the switch and exits and jumps to RESET if the switch state has changed.

When the music has finished playing the code exits and jumps to RESET.

FIG.8

CIRCUIT PUZZLE

This Utility patent application claims the Benefit of Priority of Provisional Patent Application Ser. No. 61/630,192 that was filed on Dec. 5, 2011 by the same inventors, Harry Lewis Nelson, Kevin Daniel Norman, Penelope Anne Norman, Ph.D., and Hiroshi Yamamoto entitled "Circuit Puzzle".

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to games and puzzles and, more particularly, to a puzzle that is solved by completing an electrical circuit.

Known types of puzzles come in a variety of configurations. For example, there are jigsaw puzzles, crossword puzzles, and other types of puzzles that require assembly or skilled manipulation, such as the RUBIK'S CUBE TM. In general, puzzles are intended primarily to amuse and entertain although certain types of puzzles require considerable thought and insight to solve.

The solving of a puzzle can be considered as participating in or playing a type of a game where the rules of the game are those that apply to the particular puzzle and where one or more solutions exist that "solve" the puzzle. Therefore, the object when playing a puzzle type of a game is to find a valid solution for the puzzle that satisfies all of the criteria (i.e., rules). As used herein, the terms "play", "playing", "complete", "completing", "solve", and "solving" are used interchangeably as they appertain to the use of the instant invention.

There is an ever-growing need for new types of puzzles that satisfy the need for entertainment and amusement and which also present a sufficient intellectual challenge that, when solved, the solver of the puzzle is able to experience a sense of accomplishment.

Ideally, a puzzle would include various levels of difficulty so that a user could progress from easier solutions to more challenging configurations as their level of skill increases. In this way, almost all users who possess various ability levels can find a sufficient level of difficulty to pose a challenge to their current skill and aptitude.

Additionally, it is desirable for a puzzle to be small and compact so that it can be transported more easily.

It is also desirable for a puzzle to be self-contained in that the rules, pieces, and a game board that the puzzle requires for use can be readily contained, transported, and played.

It is also desirable for a puzzle to provide an audible and/or visual indication upon successful completion (i.e., solving of the puzzle). Such an indication can help to increase the excitement that is experienced by a user when a solution is attained.

It is also desirable for a puzzle to operate off of a common size battery for ease of use and transportation (i.e., portability).

It is also desirable for a puzzle to operate off of a common size battery and to provide long battery life.

It is also desirable for a puzzle to include a plurality of templates that each provide at least some indication of a desired solution for the puzzle and which limit, to some degree, the permissible solution or solutions that are possible.

It is also desirable for a puzzle to include various templates that provide at least some indication of a desired solution for the puzzle and which represent varying degrees of difficulty, and it is further desirable that each of the templates include some indication as to the relative difficulty of the challenge that is presented by each template.

It is also desirable to provide a puzzle that is completed by creating an electrical circuit (i.e., an electrically conductive loop). However, it is important that any electrical circuit that is created should not expose a user to a hazardous voltage or current, or even to a voltage or current that could in anyway cause discomfort to the user.

It is important that upon successful creation of a desired electrical circuit to provide celebratory feedback to the user of his or her accomplishment. It is also important that such feedback should be of limited duration to conserve battery life.

Accordingly, there exists today a need for a circuit puzzle that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be useful and desirable.

2. Description of Prior Art

Puzzles are, in general, known. While the structural arrangements of known puzzles may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a circuit puzzle that is durable.

It is also an important object of the invention to provide a circuit puzzle that is inexpensive to manufacture.

Another object of the invention is to provide a circuit puzzle that is reliable.

Still another object of the invention is to provide a circuit puzzle that is fun to use.

Still yet another object of the invention is to provide a circuit puzzle that provides an audible or visual or an audible and visual indication for a period of time upon a creation of an electrical circuit by a user.

Yet another important object of the invention is to provide a circuit puzzle that does not expose a user to a hazardous voltage or current.

Still yet another important object of the invention is to provide a circuit puzzle that does not expose a user to voltage or current that can cause discomfort to the user.

A first continuing object of the invention is to provide a circuit puzzle that includes a game board and a plurality of arcuate game pieces that, when properly placed on the game board form an electrical circuit that is detected by circuitry on the game board, and wherein an indication that the puzzle has been solved is provided to a user for a period of time in acknowledgement of solving the puzzle.

A second continuing object of the invention is to provide a circuit puzzle that senses completing of an electrical circuit by inducing a current flow in the electrical circuit when the electrical circuit is completed, and by then detecting or sensing the induced current flow as an increased electrical load.

A third continuing object of the invention is to provide a circuit puzzle that uses a commonly available type of battery for its operation.

A fourth continuing object of the invention is to provide a circuit puzzle that consumes little electrical energy during play except for a short period of time after completion of an electrical circuit has occurred and an audible or visual or both an audible and visual indication is provided for a predetermined period of time.

A fifth continuing object of the invention is to provide a circuit puzzle that includes a plurality of curved game pieces that each include an electrical conductor extending a longitudinal length of each game piece and an electrical contact disposed at each opposite end of each game piece that is able to make electrical contact with the electrical conductor of an adjoining game piece when the game pieces are properly placed on a game board.

A sixth continuing object of the invention is to provide a circuit puzzle that includes a plurality of curved game pieces that each include an electrical conductor extending a longitudinal length of each game piece and an electrical contact disposed at each opposite end of each game piece, and wherein the electrical conductor also functions as a spring that urges each electrical contact a predetermined distance toward the electrical contact of an adjoining game piece.

A seventh continuing object of the invention is to provide a circuit puzzle that includes a plurality of curved game pieces that each include an electrical conductor extending a longitudinal length of each game piece and an electrical contact disposed at each opposite end of each game piece, and wherein the electrical conductor also functions as a spring that urges each electrical contact a predetermined distance toward the electrical contact of an adjoining game piece, and wherein each electrical conductor is secured in place at a location intermediate the opposite ends of the game piece, and wherein each game piece includes an opening in an interior of each game piece at each of the opposite ends of each game piece sufficient to allow movement of the opposite ends of the electrical conductor to Occur.

An eighth continuing object of the invention is to provide a circuit puzzle that includes a plurality of curved game pieces that each include an electrical conductor extending a longitudinal length of each game piece and an electrical contact disposed at each opposite end of each game piece, and wherein the electrical conductor also functions as a spring that urges each electrical contact a predetermined distance toward the electrical contact of an adjoining game piece, and wherein the electrical contact includes at least one coiled loop of the electrical conductor.

A ninth continuing object of the invention is to provide a circuit puzzle that includes game pieces that are translucent.

A tenth continuing object of the invention is to provide a circuit puzzle that includes a plurality of templates that each provide at least some indication of a desired solution for the puzzle and which limit, to some degree, a permissible solution or solutions that are possible.

An eleventh continuing object of the invention is to provide a circuit puzzle that includes various templates that provide at least some indication of a desired solution for the puzzle.

A twelfth continuing object of the invention is to provide a circuit puzzle that includes various templates that provide at least some indication of a desired solution for the puzzle and which represent varying degrees of difficulty.

A thirteenth continuing object of the invention is to provide a circuit puzzle that includes a control circuit for inducing a current flow in an electrical circuit that is disposed proximate the control circuit when the electrical circuit is completed and to include in the control circuit means for detecting the induced current flow.

A fourteenth continuing object of the invention is to provide a circuit puzzle that includes a control circuit for inducing a current flow in an electrical circuit that is disposed proximate the control circuit when the electrical circuit is completed and to include in the control circuit means for detecting the induced current flow, and to provide an audible indication or a visual indication or both an audible indication and a visual indication for a period of time upon completion of the electrical circuit using a plurality of game pieces that are properly disposed on a surface of a game board.

A fifteenth continuing object of the invention is to provide a circuit puzzle that includes a game board that houses at least one battery.

A sixteenth continuing object of the invention is to provide a circuit puzzle that includes a game board that is adapted to receive and retain each of a plurality of game pieces in an adjacent and contiguous orientation with respect to one-another sufficient to form a loop and thereby complete an electrical circuit.

A seventeenth continuing object of the invention is to provide a circuit puzzle that includes a game board that includes a drawer for housing a plurality of game pieces when the circuit puzzle is not in use.

An eighteenth continuing object of the invention is to provide a circuit puzzle that includes a game board that includes a drawer for housing a plurality of game pieces and a plurality of templates when the circuit puzzle is not in use.

A nineteenth continuing object of the invention is to provide a circuit puzzle that includes a game board that includes a plurality of cylinders that protrude vertically from a planar surface of the game board wherein the cylinders are useful in retaining any of a plurality of game pieces in the proper position on the game board.

A twentieth continuing object of the invention is to provide a circuit puzzle that includes a game board that includes an electrical cord, and wherein the electrical cord includes a first end and an opposite second end, and wherein the first end of the electrical cord includes an electrical connector that is attachable and detachable with respect to the game board, and wherein the electrical cord is adapted to electrically cooperate with the electrical connector, and wherein the second end of the electrical cord includes a momentary electrical switch, and wherein a momentary depression of the electrical switch activates an electrical control circuitry that is contained in the game board sufficient to energize for a period of time an audible indication or a visual indication or preferably both an audible and visual indication that is similar or identical to the indication that occurs when an electrical circuit that is assembled on top of the game board is completed.

A twenty-first continuing object of the invention is to provide a circuit puzzle that includes a game board that includes a plurality of semi-cylindrical shapes that are disposed along an interior perimeter of the game board and which protrude vertically from a planar surface of the game board, and wherein the semi-cylindrical shapes are useful in retaining any of a plurality of game pieces in the proper position on the game board.

A twenty-second continuing object of the invention is to provide a circuit puzzle that includes various templates that provide at least some indication of a desired solution for the puzzle and which represent varying degrees of difficulty, and it is further desirable that each of the templates include some indication as to the relative difficulty of the challenge that is presented by each template.

A twenty-third continuing object of the invention is to provide a circuit puzzle that includes a plurality of game pieces, wherein each game piece includes an electrical conductor that also functions as a spring, and wherein a novel solution is provided to secure the electrical conductor to the game piece.

A twenty-fourth continuing object of the invention is to provide a circuit puzzle that includes a plurality of game pieces, wherein each game piece includes an electrical conductor that also functions as a spring, and wherein the electrical conductor is secured to the game piece at a location of the game piece that is intermediate a longitudinal length of the game piece.

A twenty-fifth continuing object of the invention is to provide a circuit puzzle that includes a template which provides at least some indication of a desired solution (i.e., the placement of at least one game piece of a plurality of included game pieces on a specific location of a game board) for the puzzle, and to include indication of a solution for that particular template.

A twenty-sixth continuing object of the invention is to provide a circuit puzzle that includes instructions for use.

A twenty-seventh continuing object of the invention is to provide a circuit puzzle that teaches a user about electrical circuitry.

A twenty-eighth continuing object of the invention is to provide a circuit puzzle that helps teach a user that current flow cannot occur until an electrical circuit is completed.

A twenty-ninth continuing object of the invention is to provide a circuit puzzle that helps teach a user that an electrical circuit is a continuous loop.

A thirtieth continuing object of the invention is to provide a circuit puzzle that allows a user to create an electrical circuit that poses no risk to the user of experiencing an electrical shock.

A thirty-first continuing object of the invention is to provide a circuit puzzle that allows a user to create an electrical circuit by handling and placement of a plurality of game pieces on a game board, and wherein each game piece includes an electrical conductor disposed in the game piece and extending a longitudinal length of the game piece, and wherein a portion of the electrical conductor is exposed as an electrical contact at each end of the game piece, and wherein during handling and placement of the individual game pieces there exists a potential for contact with any of the electrical contacts occurring by the user, and wherein such contact with the electrical contacts can only occur prior to a completion of the electrical circuit that is formed by proper placement of the game pieces on the game board, and wherein prior to the completion of the electrical circuit there is no current flow occurring through any of the game pieces, and thereby no danger to the user.

A thirty-second continuing object of the invention is to provide a circuit puzzle that does not include any toxic or hazardous substances that could contact a user.

Briefly, a circuit puzzle that is constructed in accordance with the principles of the present invention has a game board that is able to receive each of eight distinctly-shaped arcuate game pieces, thereon. There are numerous possible combinations for the placement of the game pieces on the game board in which all of the pieces are utilized to form a contiguous (i.e., continuous) loop. An electrical conductor that extends from a first end to an opposite second end of each game piece is disposed in the game piece and is secured in a novel manner that permits opposite ends of the electrical conductor to function as a mechanical spring. The first end and the second end of the electrical conductor each terminate in a loop that includes one or more coils of a wire that is used to form the electrical conductor. A portion of the loop at the first end of each game piece extends out of an opening that is provided at the first end of the game piece. A portion of the loop at the second end of each game piece extends out of an opening that is provided at the second end of the game piece. The loop, in cooperation with the spring constant of the wire, functions as an electrical contact that is used to create electrical continuity between it and another loop of an adjoining game piece that is properly placed on the game board. A void is provided in an interior of each game piece at the first end and also at the second end of the game piece. The voids allow for a slight amount of movement of the loop to occur along with a slight flexing of a portion of the wire in the game piece at the first end and at the second end of the game piece when the loop is forced into contact with an adjoining loop. This occurs whenever a new game piece is placed on the game board with either the first or the second end of the new game piece being disposed adjacent to the first or second end of a game piece that was previously placed on the game board. The electrical conductor is retained in position in each game piece by a constriction that pinches the electrical conductor. The constriction occurs proximate a center of a longitudinal length of each game piece. A fulcrum that allows pivoting of each end of the wire to occur is provided at a pair of opposite ends of the constriction. A portion of the wire (i.e., the electrical conductor) that extends from the end of the constriction to the loop at each end of the game piece is able to be displaced slightly within the void that is provided at each end. The game board includes a planar surface that provides an active area for the placement of the various game pieces. A plurality of upright cylindrically-shaped protrusions extend upward from the planar surface. A plurality of upright semi-cylindrical protrusions extend upward from the planar surface along a raised perimeter of the game board. The cylindrically-shaped protrusions and the semi-cylindrical protrusions help retain each of the game pieces in a desired position by limiting the amount of motion (i.e., movement) that is possible for each game piece on the game board. The tendency toward movement occurs in response to the force exerted upon each game piece by the spring constant of the electrical conductor and the flexing of a portion of the wire of each adjoining game piece. A plurality of templates are included. The templates include cutout areas for the cylindrically-shaped protrusions and the semi-cylindrical protrusions and are able to be placed directly on the planar surface of the game board prior to play. Each template provides at least some information as to the location and contour of a possible loop or circuit that can be formed by the use of all of the game pieces. The amount of information that is provided on each template is a variable. In general, the less information provided by the template the greater the difficulty in completing the puzzle. Simply stated, the puzzle is completed by properly placing all eight of the game pieces on the game board to form the contiguous (i.e., continuous) loop. Additional discussion about puzzle completion is included below. Once the loop is formed an electrical circuit (i.e., an electrically conductive loop) is completed. An electrical control circuit is included in the game board beneath the planar surface. During use, an electro-magnetic field is produced by the electrical control circuit that extends above the planar surface. When the electrical circuit formed by the game pieces is completed, an induced current flow is experienced by the electrical circuit. The electrical control circuit senses the suddenly occurring induced current. The detected induced current flow is used as a trigger event to activate additional electrical circuitry to indicate to a user the successful completion of the puzzle by assembly of all of game pieces to create the electrical circuit. The electrical control circuit simultaneously activates for a predetermined period of time an audible indication and a visual indication as a triumphant indication to the user that he or she has successfully completed the puzzle. It requires thought, care, and experimentation to properly assemble all eight game pieces and successfully complete the electrical circuit (i.e., the loop). The game pieces are preferably formed of a translucent material. A plurality of light-emitting diode (LED) lights are disposed under the planar surface. The LED lights are intermittently turned on and off in unison or in any desired pattern to provide the visual indication. A portion of the light emanated by the LED lights passes through the planar surface and also through the translucent game pieces as the visual indication. The light passing through the translucent game pieces is used to add greater visual appeal to the puzzle during the time that the LEDS are illuminated (i.e., during the visual indication). A desired excerpt from a song, tune, melody or musical composition is played through a speaker that is included with the game board as the audible indication while the LEDS are being illuminated or flashed on and off. A reflective layer is disposed under the LEDS in the game board and is used to increase the amount of light that is emanated through the planar surface. A detachable electrical cord is provided and is attached to the game board by a manufacturer prior to packaging and shipment. A momentary switch is included at a distal end of the electrical cord that, when depressed, activates the audible and visual indication and produces a visual and auditory output that is the same as a user would experience if the puzzle had just been solved after proper insertion on the game board of a final game piece. In this way a person in a retail store can depress the momentary switch and experience what would happen in the moments that occur immediately after completion of the puzzle. The electrical cord can be detached during use or it can remain connected to the game board, if preferred. One or more replaceable batteries are included in the game board prior to shipment. A drawer is included in the game board that is able to house the plurality of templates and all eight game pieces when not in use. The use of eight game pieces is preferred as it provides a generally desired range of difficulty although it is to be understood that either more or less than eight game pieces are possible. Similarly, the active area of the game board can be decreased to include fewer possible game piece placements to provide a simpler version of the circuit puzzle or, conversely, the active area of the game board can be increased to include an increased number of possible game piece placements to provide a more challenging version of the circuit puzzle. To properly solve the puzzle as presented by the template (i.e., any given template) the user must place a game piece directly over all of the markings (i.e., lines) that appear on the template. Each game piece that is placed over the marking must correspond in shape and position with the marking. The template may indicate one or more break points of the game pieces or it may not. The break points of the actual game pieces that are placed over the markings must correspond with the break points as shown on the template. The user must then experiment in placing various combinations of the remaining game pieces on the game board in order to complete the puzzle. A complete statement of the requirements for the completion or solving of a circuit puzzle is that the puzzle is completed (i.e., solved) only if the markings and break points as shown on the template (if break points are included on the template) correspond (i.e., correlate) perfectly with the placement of certain of the game pieces and game piece break points that are disposed over the markings, and only if the first and second ends of each game piece are disposed adjacent to either the first or second ends of two other adjoining game pieces, and only if a contiguous (i.e., continuous) loop comprising all eight game pieces is formed.

BRIEF DESCRIPTION OF THE DRAWINGS

FIG. 8 is a brief description of the flowchart of FIG. 7.

DETAILED DESCRIPTION OF THE INVENTION

Figure 1:
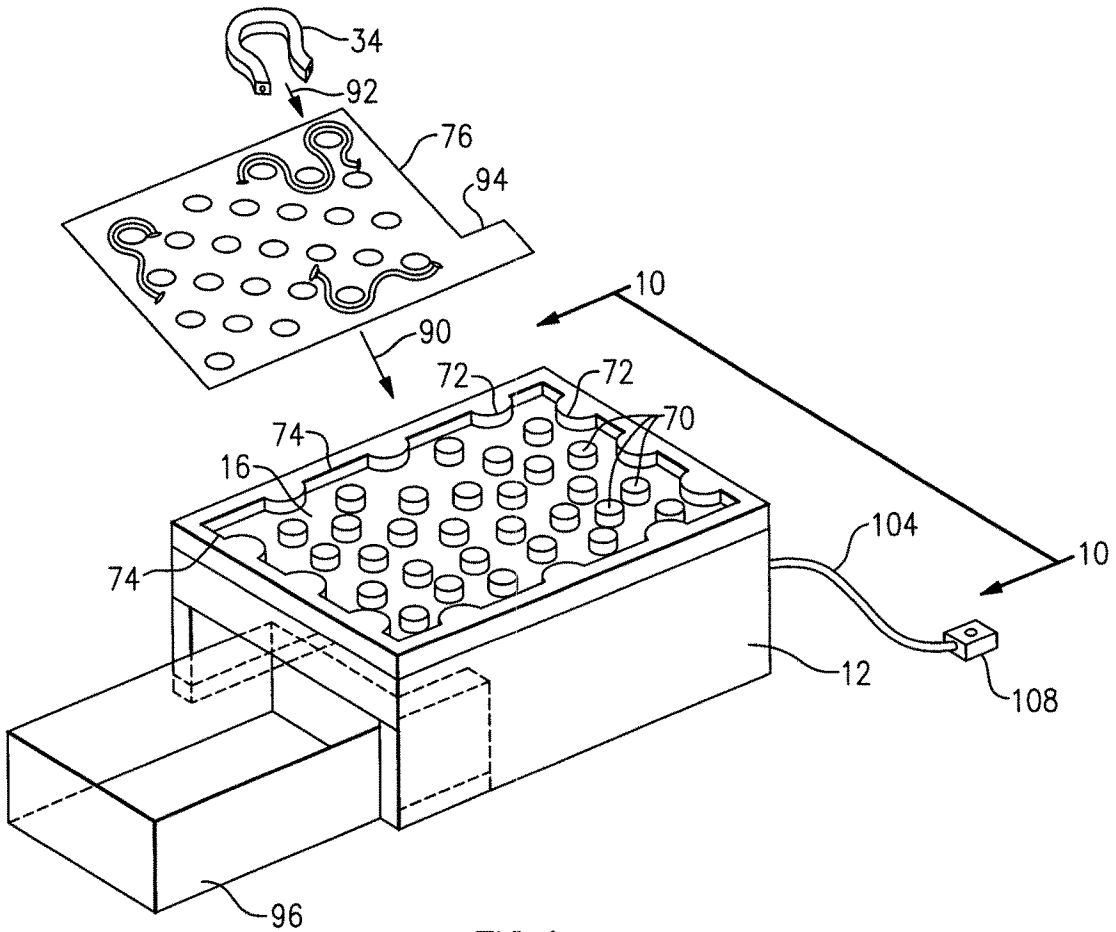
FIG. 1 is a view in perspective of a circuit puzzle game board with a drawer shown in an open position and an electrical cord and a momentary switch attached to the game board.

Referring on occasion to all of the FIGURE drawings and now, in particular to FIG. 1, is shown a circuit puzzle, identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

Figure 9:
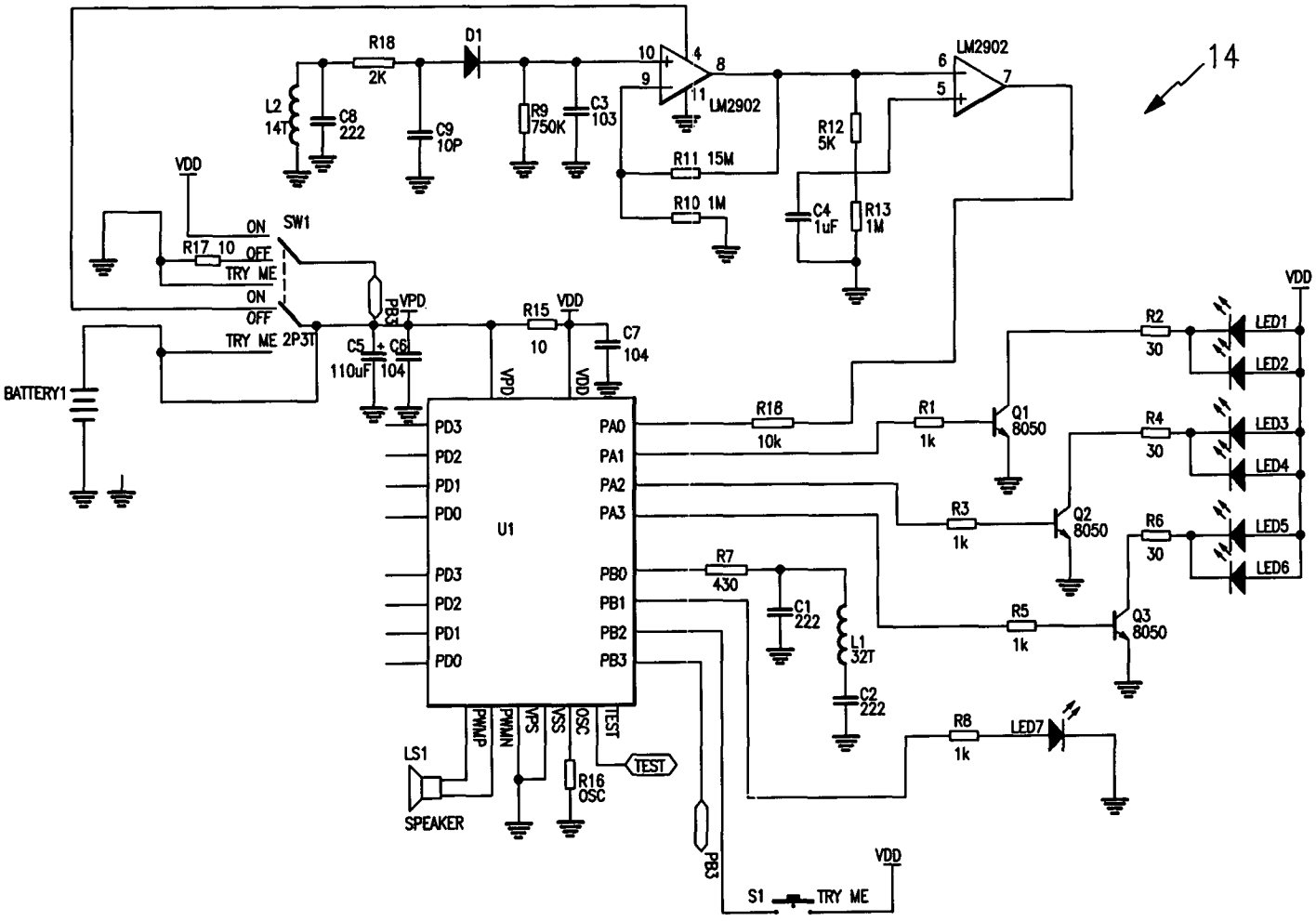
FIG. 9 is a schematic of the electrical control circuitry of the circuit puzzle.

The circuit puzzle 10 includes a game board 12 that also functions as a housing for an electrical control circuit (identified in general by reference numeral 14, FIG. 9). The game board 12 includes a planar surface 16 that is able to receive each of eight distinctly-shaped arcuate game pieces, identified in general by the reference numeral 18, FIG. 2.

Figure 2:
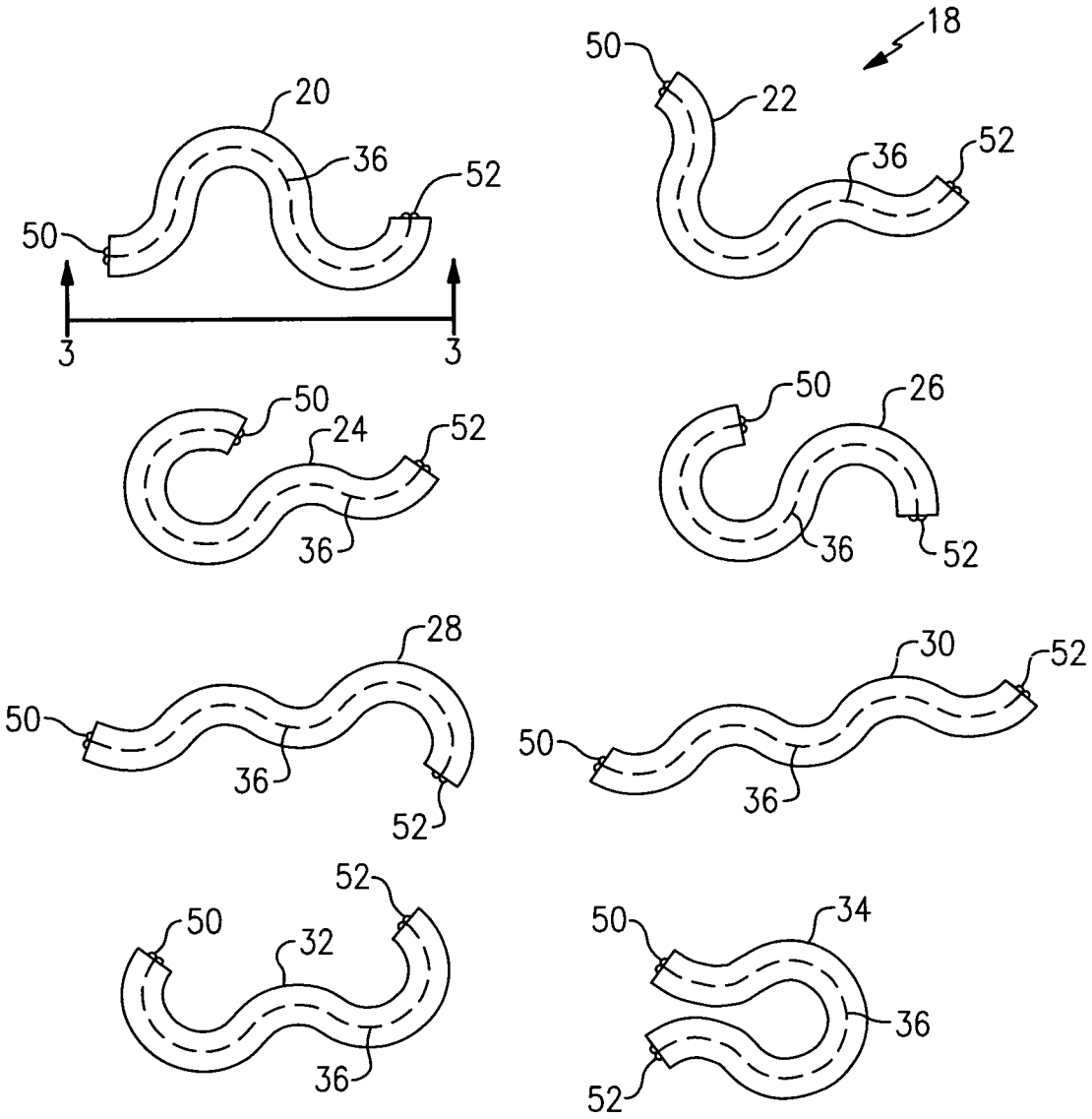
FIG. 2 is a plan view of a plurality of game pieces that are placed on a planar surface of the game board during use.

Referring now momentarily to FIG. 2 the game pieces 18 include a first game piece 20, a second game piece 22, a third game piece 24, a fourth game piece 26, a fifth game piece 28, a sixth game piece 30, a seventh game piece 32, and an eighth game piece 34.

Figure 3:
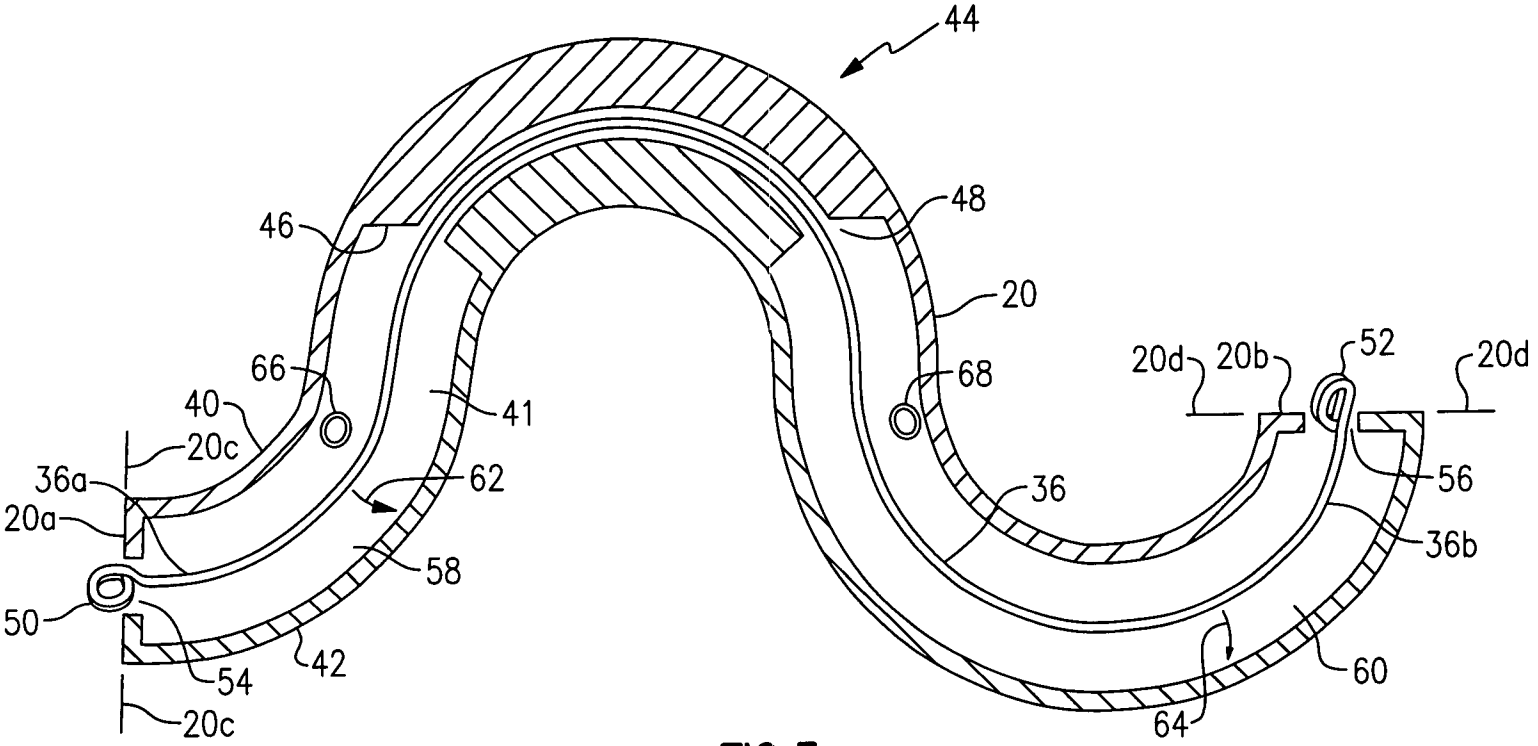
FIG. 3 is a cross sectional view of a game piece taken on the line 3-3 in FIG. 2.
Figure 4:
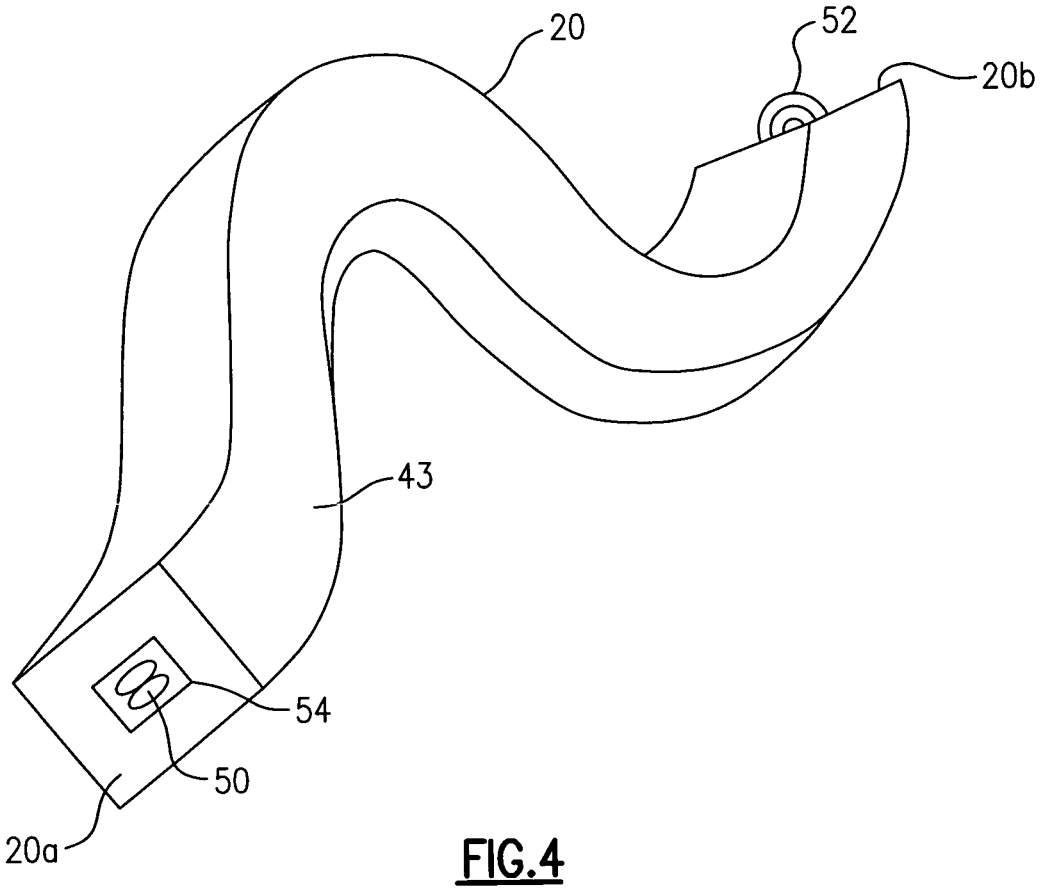
FIG. 4 is a view in perspective of the game piece of FIG. 3.

Referring now momentarily to FIG. 3 is shown a cross-sectional view of the first game piece 20 and referring momentarily to FIG. 4 is shown a view in perspective of the first game piece 20. Each of the game pieces 18 includes a unique curvature or shape, as shown in FIG. 2. However, each of the game pieces 18 is substantially similar in construction and usage as compared to the first game piece 20.

Referring again to FIG. 3 and to FIG. 4, the first game piece 20 includes an electrical conductor 36 that extends from a first end 20*a* of the first game piece 20 to an opposite second end 20*b* of the first game piece 20 along a center longitudinal length of the first game piece 20. The electrical conductor 36 is formed of a bare wire. The material used to form the wire is selected to provide electrical conductivity as well as a spring-like quality to the electrical conductor 36. The reason for this is discussed in greater detail below.

A significant challenge to the creation of any game or toy or puzzle is that it must be inexpensive to manufacture to keep the retail cost as low as possible, yet sufficiently reliable. In particular, to solve the circuit puzzle 10 numerous plastic pieces (i.e., the game pieces 18) are all placed in a proper position on the planar surface 16 so that the game pieces 18 connect with one another physically as well as electrically to form an electrical circuit or loop (identified in general by reference numeral 38, FIG. 6).

The creation of the game pieces 18 that are easy and inexpensive to manufacture, which can be reliably built using available machinery to fabricate the various component parts of each of the game pieces 18, that can be assembled with reduced risk of error, and which can also maintain electrical continuity when properly disposed on the planar surface 16 of the game board 12, represented a significant challenge to overcome. The design of the game board 12 and of each of the game pieces 18 and how the structure of the game board 12 cooperates with the game pieces 18 is critical to the successful and reliable creation of the electrical circuit 38.

Referring now in particular to FIG. 3, the first game piece 20 includes a pair of vertical opposing side panels 40, 42 that extend from the first end 20*a* to the second end 20*b*. Referring also to FIG. 4, a pair of horizontal opposing side panels 41, 43 are disposed between the vertical side panels 40, 42. The horizontal opposing side panels 41, 43 are perpendicular with respect to the vertical side panels 40, 42.

The electrical conductor 36 passes generally along the center longitudinal axis of the first game piece 20 and is surrounded by the vertical side panels 40, 42 and by the horizontal opposing side panels 41, 43.

A constriction, identified in general by the reference numeral 44, is provided inside of the first game piece 20 proximate a midpoint between the first end 20*a* and the second end 20*b*. The constriction 44 is formed by sufficiently increasing the wall thickness of the vertical side panels 40, 42 so that a gap between the vertical side panels 40, 42 is small enough to pinch the electrical conductor 36 when it is inserted therein during manufacture. The constriction 44 retains the electrical conductor 36 in position in the first game piece 20.

On a first side of the constriction 44, where the electrical conductor 36 exits from the constriction 44, is provided a first fulcrum 46 or first pivot point for the electrical conductor 36. On an opposite side of the constriction 44, where the electrical conductor 36 exits from the constriction 44, is provided a second fulcrum 48 or second pivot point for the electrical conductor 36.

Other structural changes other than increasing the wall thickness of the vertical side panels 40, 42 is also possible to provide the constriction 44. For example, a pair of opposing members (not shown) can be included in the first game piece 20 wherever the first and second fulcrums 46, 48 are desired. The opposing members would include a sufficiently small gap there-between to pinch and retain the electrical conductor 36 where desired.

A first end 36*a* of the electrical conductor 36 includes a first loop 50. The first loop 50 is formed by bending the first end 36*a* of the electrical conductor 36 in a circle to form a coil. At least one loop of the wire that is used to form the electrical conductor 36 is required to form the first loop 50, although multiple loops of the wire are generally preferred. Such fabrication can be accomplished by current machinery, thereby keeping manufacturing cost especially low.

A second end 36*b* of the electrical conductor 36 includes a second loop 52. The second loop 52 is similarly formed by bending the second end 36*b* of the electrical conductor 36 in a circle to form a coil. At least one loop of the wire that is used to form the electrical conductor 36 is required to form the second loop 52, although multiple loops of the wire are generally preferred.

A first end opening 54 is provided in the first end 20*a* of the first game piece 20. The first end opening 54 allows at least a portion of the first loop 50 to extend out of an interior of the first game piece 20. At least some portion of the first loop 50 must extend beyond a first exterior plane of the first end 20*a*, as shown by lines 20*c*.

A second end opening 56 is provided in the second end 20*b* of the first game piece 20. The second end opening 56 allows at least a portion of the second loop 52 to extend out of the interior of the first game piece 20. At least some portion of the second loop 52 must extend beyond a second exterior plane of the second end 20*b*, as shown by lines 20*d*.

Figure 6:
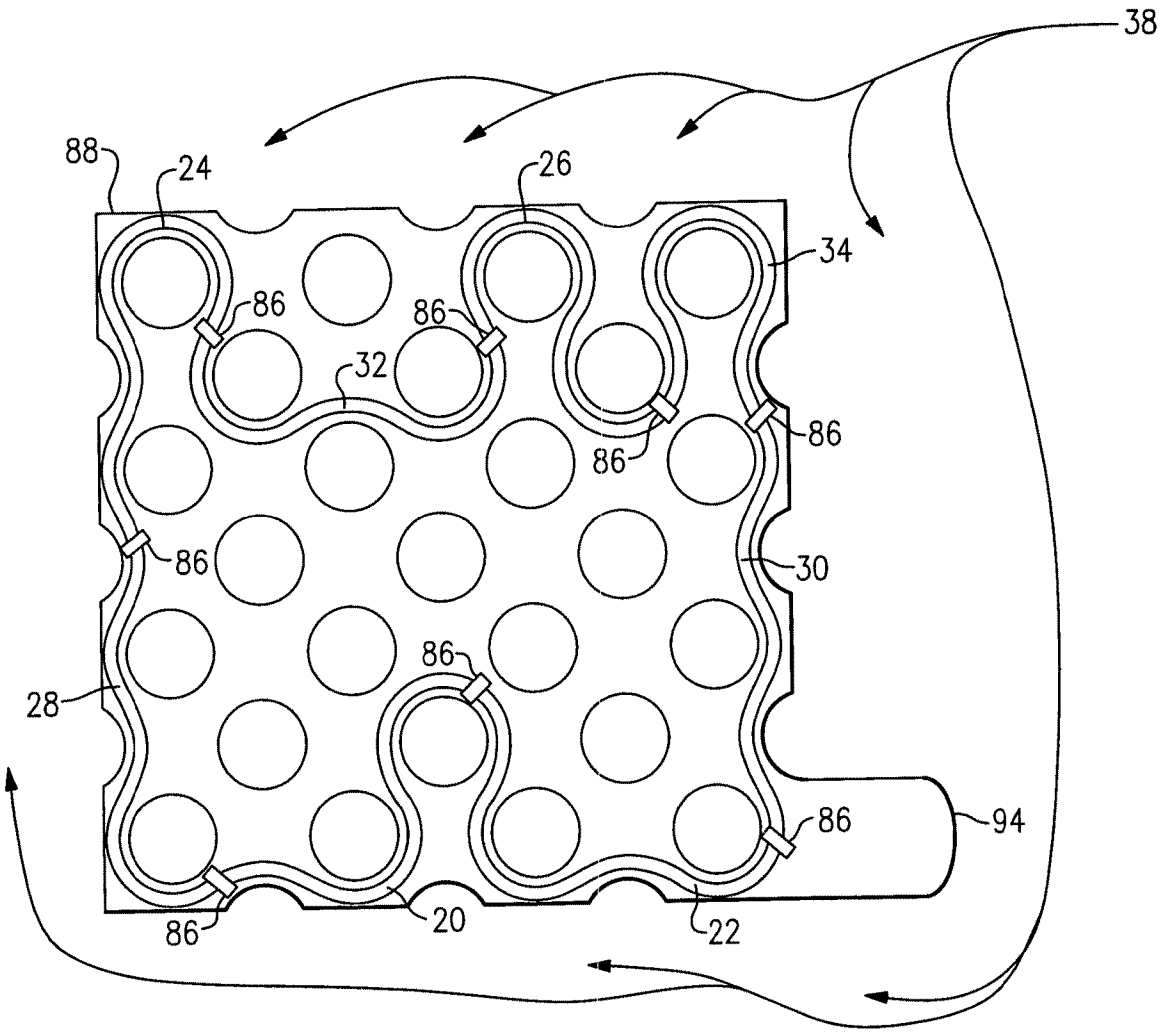
FIG. 6 is a plan view of a solution for the sample template of FIG. 5.

Referring now briefly to FIG. 6, it is shown how the electrical circuit 38, when completed, is formed by arranging in an acceptable manner on the planar surface 16 of the game board 12 each of the eight game pieces 20-34. A first end 20*a* of each one of the eight game pieces 20-34 abuts either the first end 20*a* or the second end 20*b* of one of the remaining game pieces 20-34. A second end 20*b* of each one of the eight game pieces 20-34 abuts either the first end 20*a* or the second end 20*b* of one of the remaining game pieces 20-34.

In this manner all of the game pieces 20-34 interconnect to form a loop comprised of all eight of the game pieces 20-34. Because electrical conductivity extending through each of the electrical conductors 36 of each of game pieces 18 occurs, the electrical circuit 38 is formed. It is referred to as the electrical circuit 38 herein because it is capable of experiencing current flow. This is described in greater detail, hereinafter.

In order to ensure that electrical conductivity occurs through all of the various game pieces 20-34, the first and second loops 50, 52 function as electrical contacts. When any, for example, the first game piece 20 is properly placed on the game board 12 in between two of the remaining game pieces 18 the first loop 50 of the first game piece 20 bears against either a first loop 50 or against a second loop 52 of one of the adjoining game pieces (any of game pieces 22-34). Similarly, the second loop 52 of the first game piece 20 bears against either a first loop 50 or against a second loop 52 of another one of the adjoining game pieces (any of the game pieces 22-34 except the one that is in contact with the first loop 50).

The first and second loops 50, 52 of each game piece 20-34 provide a sufficiently large area to ensure that contact occurs with the corresponding first or second loops 50, 52 of each adjoining game piece 20-34. This provides tolerance to compensate for slight misalignment among the game pieces 18 and for manufacturing tolerances.

Additionally, another important need is satisfied by the instant design. When any of the loops 50, 52 make contact with any of the loops 50, 52 of an adjoining game piece 20-34 the loops 50, 52 must protrude sufficiently far out of the first exterior plane 20*c* of the first end 20*a* and the second exterior plane 20*d* of the second end 20*b* to be able to make contact with the loop 50, 52 of the adjoining game piece 20-34.

However, if the loops 50, 52 were not able to be urged inward a variable amount as required at each connection point toward an interior of the game pieces 18, the overall combined length of the game pieces 18 would exceed the space available for the electrical circuit 38. The capacity for the loops 50, 52 to flex (i.e., be urged) inward into the interior of the game pieces 18 (referring now for example to the first game piece 20 in FIG. 3) arises because the wire used to form the electrical conductor 36 exhibits the property of hysteresis and thereby functions as a spring.

The area between the first fulcrum 46 and the first end 20*a* inside of the first game piece 20 includes a first void 58. The area between the second fulcrum 48 and the second end 20*b* inside of the first game piece 20 includes a second void 60.

When a sufficient force is exerted on the first loop 50 the first end 36*a* of the electrical conductor 36 is urged inward toward the first void 58. The first end 36*a* of the electrical conductor 36 pivots about the first fulcrum 46 in a direction as shown by arrow 62 an amount necessary to ensure that proper electrical connection is made and to compensate for mechanical tolerances.

Similarly, when a sufficient force is exerted on the second loop 52 the second end 36*b* of the electrical conductor 36 is urged inward toward the second void 60. The second end 36*b* of the electrical conductor 36 pivots about the second fulcrum 48 in a direction as shown by arrow 64 an amount necessary to ensure that proper electrical connection is made and to compensate for mechanical tolerances.

When the first game piece 20 is removed from the game board 12, the first loop 50 is urged outward as the first end 36*a* of the electrical conductor 36 pivots about the first fulcrum 46 in a direction opposite to that as shown by arrow 62 and the second loop 52 is urged outward as the second end 36*b* of the electrical conductor 36 pivots about the second fulcrum 48 in a direction opposite to that as shown by arrow 64.

The construction of each of the remaining game pieces 22-34 is identical to that of the first game piece 20 except that each of the remaining game pieces 22-34 includes a unique curvature or arcuate shape. When all eight game pieces 20-34 are assembled to form the electrical circuit 38, a complete loop, or 360 degrees of total arc rotation, are provided by the combined curvature of all of the game pieces 18, as arranged.

Each game piece 20-34 is preferably formed of a lower half (as indicated by the portion of the first game piece 20 shown in FIG. 3) and an upper half (not shown). After insertion of the electrical conductor 36 in the lower half the upper half is placed over the lower half and the upper and lower halves are secured together by any preferred method. A preferred method includes ultrasonic welding although other methods, including the use of an adhesive, or a snap-fitting together of the upper and lower halves is possible.

The lower half of the first game piece, as shown in FIG. 3, includes a first vertical post 66 and a second vertical post 68 that each extend upward from a first of the horizontal opposing side panels 41 and cooperate with a corresponding post portion of the upper half (not shown) that extends downward from a second of the horizontal opposing side panels 43. The vertical posts 66, 68 are used to facilitate assembly. If desired, they could also be used to provide a fulcrum where desired for the pivoting of either the first or second ends of the electrical conductor 36*a*, 36*b*.

Accordingly, a low-cost and reliable method for establishing electrical continuity of the electrical control circuit 38 is provided by the instant design.

The planar surface 16 of the game board 12 provides an active area for the placement of the various game pieces 18.

Referring again to FIG. 1, a plurality of upright cylindrically-shaped protrusions 70 extend upward from the planar surface 16. A plurality of upright semi-cylindrical protrusions 72 extend upward from the planar surface 16 along a raised perimeter 74 of the game board 12. The cylindrically-shaped protrusions 70 and the semi-cylindrical protrusions 72 help retain each of the game pieces 18 in a desired position by limiting the amount of motion (i.e., movement) that is possible for any of the game pieces 20-34 on the game board 12. The tendency toward movement occurs in response to the force exerted upon each game piece 20-34 by the spring constant of the electrical conductor 36 of each adjoining game piece 20-34.

There are numerous possible combinations for the placement of the game pieces 18 on the game board 12 in which all of the game pieces 18 are utilized to form a contiguous (i.e., continuous) loop of the electrical circuit 38. While it is possible to place any one of the game pieces 18 on the game board 12 at random and then experiment by placing, removing, or rearranging each remaining game pieces 20-34 on the game board 12 until one possible pattern for the electrical circuit 38 is formed, there are easier and better ways of using the circuit puzzle 10.

Figure 5:
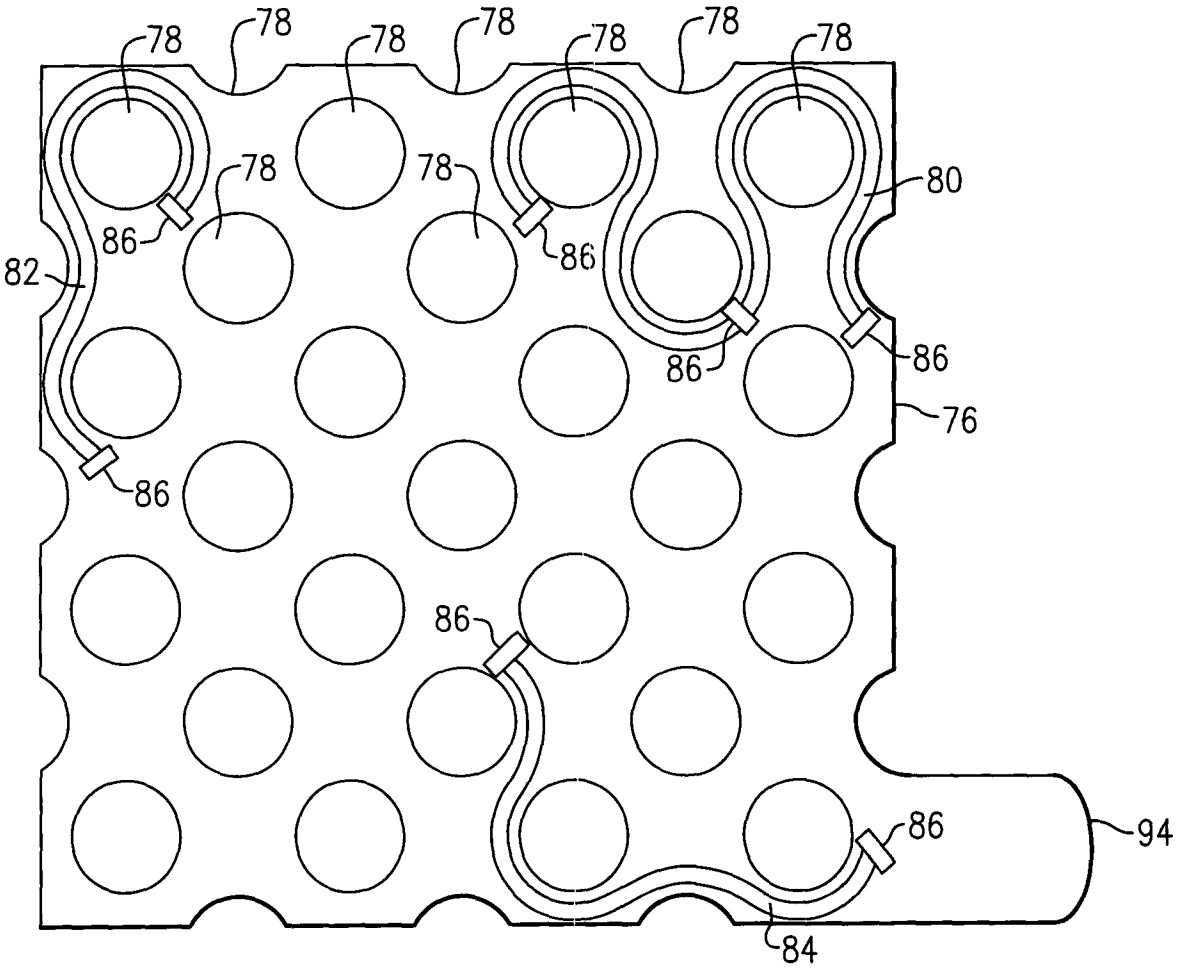
FIG. 5 is a plan view of a sample template that is placed atop the planar surface of the game board of FIG. 1.

A better way to use the circuit puzzle 10 is by the use of a template 76 (See FIGS. 1, 5 and 6). The template 76 is representative of one of many possible different templates 76 that are included with the circuit puzzle 10.

Each of the templates 76 includes a plurality of cutout areas or openings 78 to allow passage of the cylindrically-shaped protrusions 70 and the semi-cylindrical protrusions 72. During normal play, the desired template 76 is placed directly on the planar surface 16.

Each of the templates 76 provides at least some information as to the location and contour (i.e., position on the game board 12 of a portion of the electrical circuit 38). The electrical circuit 38 is completed by placement of each of the game pieces 18 on the template 76, complying with the information provided on the template 76, until a circuit or complete loop comprised of all of the eight game pieces 20-34 is formed.

The amount of information that is provided on each template 76 is a variable. In general, the less information provided by the template 76 the greater the difficulty in completing the puzzle (i.e., forming the desired electrical circuit 38 atop the template 76).

The information included on the selected template 76 includes a plurality of lines 80, 82, 84 that are imprinted on the surface of the template 76. The lines 80-84 provide a location for the placement of certain of the game pieces 18. The template 76 may also indicate one or more break points 86. The break points 86 define the ends of certain of the game pieces 20-34. The user must select from among all of the game pieces 18 those particular game pieces 18 that correspond with the shape of the lines 80-84 and the break points 36.

As shown for the selected template 76, the requirements of the line 80 and the break points 86 of line 80 are satisfied by placing the fourth game piece 26 and the eighth game piece 34 over the line 80 of the template 76 after the template 76 has been placed on the planar surface 16.

Similarly, the requirements of the line 82 and the break points 86 of line 82 are satisfied by placing the third game piece 24 over the line 82 of the template 76.

Finally, the requirements of the line 84 and the break points 86 of line 84 are satisfied by placing the second game piece 22 over the line 84 of the template 76.

The user then experiments with the remaining four game pieces 20, 28, 30, and 32 arranging them in various ways over the template 76 until the puzzle is solved, as shown in FIG. 6. The proper positioning of the remaining game pieces 20, 28, 30, and 32 on the template 76 to complete the electrical circuit 38 is indicated by a line drawing that is provided on a solution sheet 88 that is provided for each of the different templates 76.

Referring to FIG. 1, arrow 90 shows how to place the template 76 on the planar surface 16. Arrow 92 shows how to place the eighth game piece 34 in the proper position on the template 76. The remaining game pieces 20-32 are similarly placed on the template 76, as discussed above, in order to solve the puzzle by completing one of the many possible configurations of the electrical circuit 38 on top of the template 76 on the planar surface 16 of the game board 12. After completion of the puzzle the user may refer to the solution sheet 88 to confirm that he or she has achieved the proper or acceptable solution for that particular template 76.

The moment that the last of the eight game pieces 20-34 is placed on the template 76 an audible and a visual indication is provided confirming successful completion of the circuit (i.e., creation of the electrical circuit 38) has occurred. This is discussed in greater detail, hereinafter.

To again create another alternate solution (i.e., another possible electrical circuit 38) for the circuit puzzle 10 the game pieces 18 and the template 76 are removed from the game board 12. An alternate one of the templates 76 is placed on the game board 12 and the process is repeated, as previously described.

To properly solve the puzzle as presented by the template 76 (i.e., any given template 76) the user must place a game piece 20-34 directly over all of the lines 80-84 (certain templates 76 may have a greater or fewer number of the lines 80-84 depending on the difficulty) that appear on the template 76. Each game piece 20-34 that is placed over each line 80-84 must correspond both in shape and in position with the line 80-84. The first end 20*a* and the second end 20*b* of each game piece 20-34 that is placed on the template 76 must correspond with the break points 86 that appear on the template 76. The user must then experiment in placing various combinations of the remaining game pieces 20-34 on the template 76 on the game board 12 in order to complete the puzzle.

The full criteria for solving each of the template 76 puzzles is that the puzzle is completed (i.e., solved) only if the lines 80-84 and the break points 86 as shown on the template 76 (if break points 86 are included on the template 76) correspond (i.e., correlate) perfectly with the placement of certain of the game pieces 20-34 on the template 76, and only if the first and second ends 20*a*, 20*b* of each game piece 20-34 are disposed adjacent to either the first or second ends 20*a*, 20*b* of two other adjoining game pieces 20-34, and only if a contiguous (i.e., continuous) loop comprising all eight game pieces 20-34 is formed to create the electrical circuit 38.

Simply stated, the puzzle is completed (solved) by properly placing all eight of the game pieces 20-34 on top of the template 76 on the active area of the game board 12 to form a contiguous (i.e., continuous) loop or circuit which forms the electrical circuit 38 and is in compliance with the information provided by the template 76.

Each template 76 preferably includes a tab portion 94 that is used to aid in the handling of the template 76.

Figure 10:
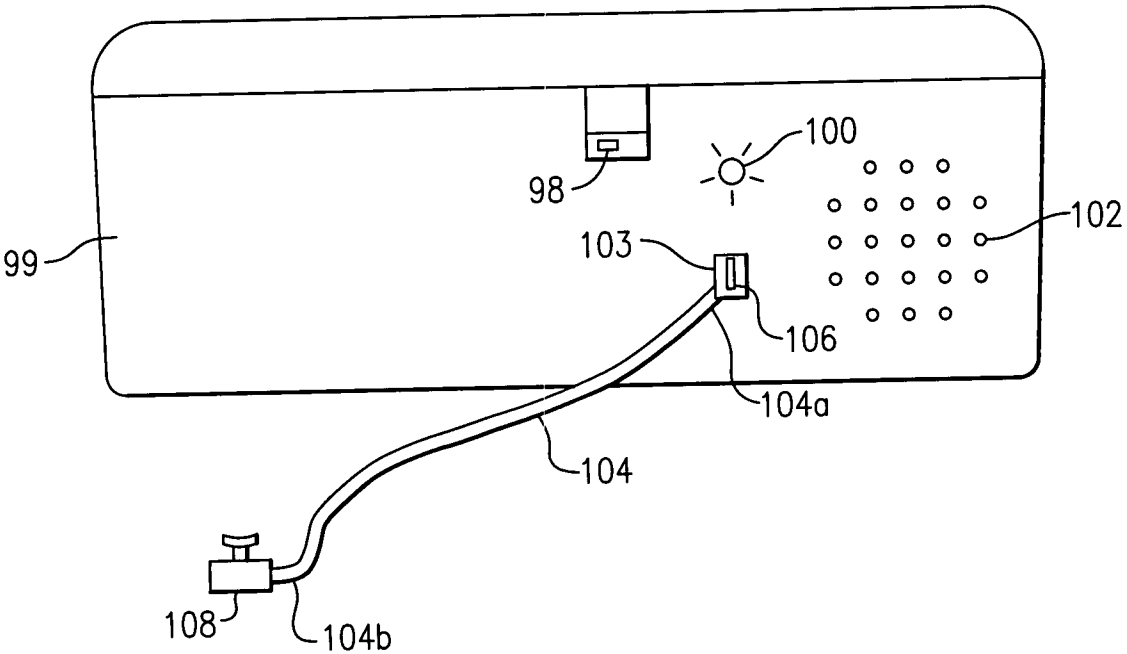
FIG. 10 is a view as shown in FIG. 1 as seen along the lines 10-10, therein.

Referring now to both FIG. 1 and to FIG. 10, a drawer 96 is shown in an open position. The templates 76 are placed in a bottom of the drawer 96 and the game pieces 18 are placed in the drawer 96 on top of the templates 76 when the circuit puzzle 10 is not in use. A shape of a bottom surface of the drawer 96 corresponds with an overall shape of the template 76. The inside dimensions of the drawer 96 are larger than the outside dimensions of the template 76 to allow placement of all of the templates 76 in the drawer 96.

A power switch 98 is used to turn the game board 12 on and off. When it is turned on, an LED 100 visible through a hole proved in a side panel 99 of the game board 12 is illuminated.

A plurality of small openings 102 in the side panel 99 are disposed over a speaker. The speaker is used to provide an audible indication upon each successful completion of the electrical circuit 38 providing the power switch 98 is in the "ON" position. The audible indication is discussed in greater detail, hereinafter.

An electrical connector 103 is provided on the side panel 99. A detachable electrical cord 104 is provided that includes a first end 104*a* and an opposite second end 104*b*. The first end 104*a* of the electrical cord 104 includes a corresponding electrical connector 106 that is attachable and detachable with respect to the electrical connector 103. The second end 104*b* of the electrical cord 104 includes a momentary electrical switch 108.

A momentary depression of the electrical switch 108 is sensed by the electrical control circuit 14 that is contained in the game board 12 and is used to energize, for a period of time, the audible indication or the visual indication or preferably both the audible and the visual indication, providing the power switch 98 is in the "ON" position. The audible and visual indication that occurs in response to activation of the electrical switch 108 produces a visual and auditory output that is the same as a user would experience if the puzzle had just been solved after proper insertion on the game board 12 of a final game piece 20-34.

A hole is provided in a box (not shown) that is used to package the circuit puzzle 10. The hole is located immediately above the momentary electrical switch 108. In this way a person in a retail store can place a tip of a finger through the hole and depress the momentary electrical switch 108 to experience what would happen in the moments that occur immediately after completion of the puzzle (i.e., after the final game piece 20-34 is placed on the template 76 on the game board 12 to complete the electrical circuit 38). The box preferably includes the words "TRY ME" proximate the hole to encourage sampling of the audible and visual indications.

The electrical cord 104 can be detached from the side panel 99 during use by urging the corresponding electrical connector 106 out of the electrical connector 103. If desired, the electrical cord 104 and the momentary electrical switch 108 can remain connected to the game board 12, if preferred.

The use of a "TRY ME" button is known for prior art toys, however, it is built into the toy itself. A detachable "TRY ME" electrical cord 104 and momentary electrical switch 108 are believed to be new and to provide distinct advantages over the known prior art designs. An advantage of leaving the electrical cord 104 connected is that, if desired, the momentary electrical switch 108 can be depressed whenever desired to again experience the sights and sounds that are produced by the audible and visual indications prior to a completion of the puzzle. An advantage of being able to remove it is to prevent the unintentional activation of the audible and visual indications prior to a solving of the puzzle by creating the electrical circuit 38. In this way the user is able to configure the circuit puzzle 10 to match their personal preference.

One or more replaceable batteries (not shown) are included in the game board 12 prior to shipment in order to permit sampling of the audible and visual indications by potential consumers. Such sampling is expected to stimulate interest and increase sales of the circuit puzzle 10.

An instruction manual (not shown) is included in the box. The instruction manual describes the object of the circuit puzzle 10, identifies the game pieces 18 and what components are included in the box, describes in general the templates 76 (which are called puzzle cards in the box), illustrates a partially completed circuit (i.e., a partially completed electrical circuit 38) that is missing two of the game pieces 20-34, includes two tutorial puzzles that indicate the solution to begin with, and include a grouping of the solutions 88 to the various templates 76 according to their difficulty level.

The partially completed circuit 38 is included to build confidence in the user as the user can readily determine proper placement of the two remaining game pieces 20-34 and to allow the user to quickly experience the audible and visual indications that occur after the electrical circuit 38 is completed. The instruction manual also instructs the user to ensure that the power switch 98 is in the "ON" position prior to placing the final remaining two game pieces 20-34 on the game board 12.

The game pieces 18 are preferably formed of a translucent type of plastic (or other material) in order to see the lines 80-84 and the break points 86 underneath the game pieces 18. The translucent material also helps to increase the intensity of the visual indication by allowing illumination to pass through the game pieces 18 when the visual indication is active.

Referring again to FIG. 9, is shown a schematic of the circuitry for the electrical control circuit 14. A microcomputer (i.e., processor U1) is included in the electrical control circuit 14.

Figure 7:
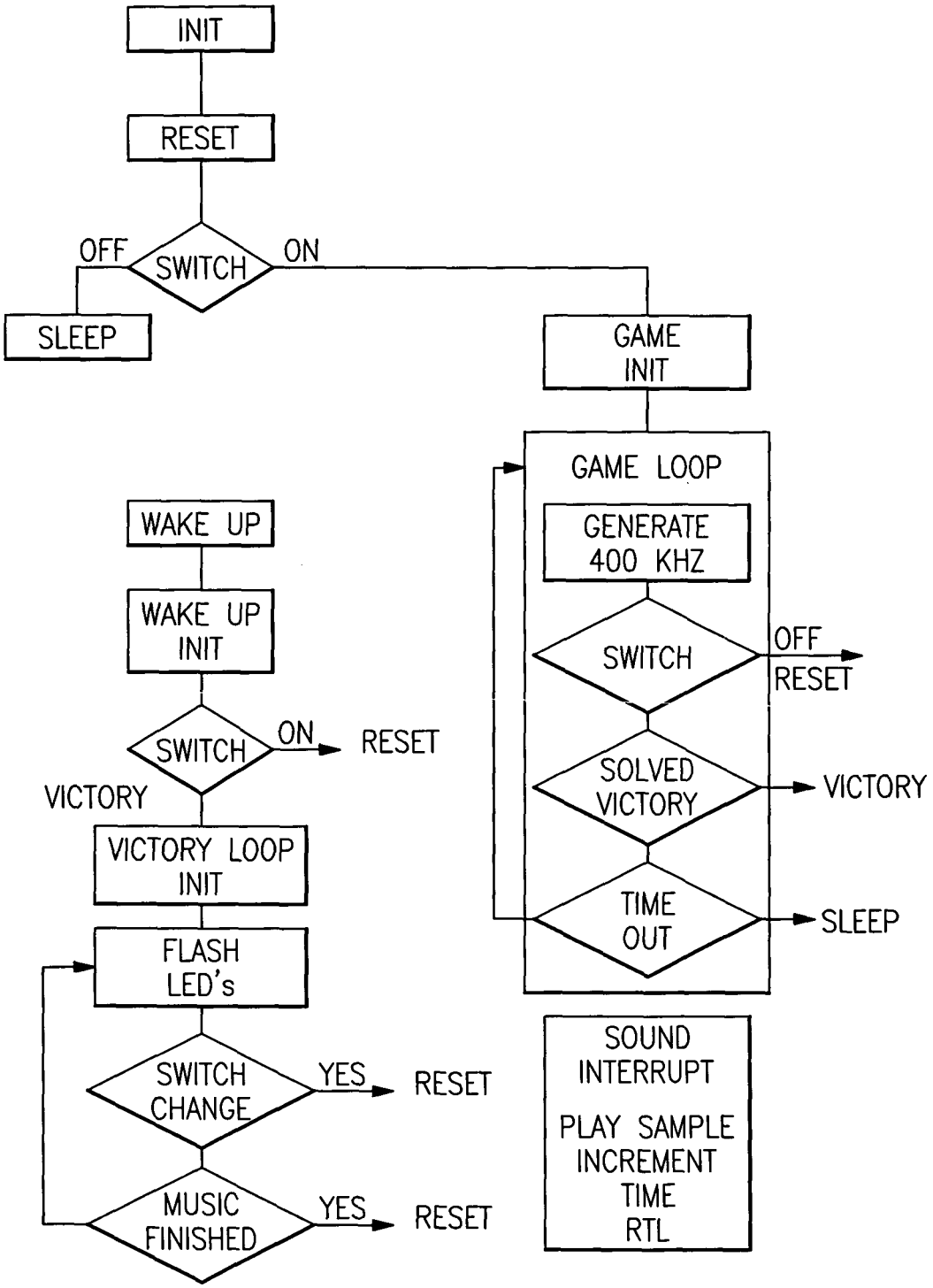
FIG. 7 is a flowchart of the basic operation of a microprocessor that is included as a component part of electrical control circuitry that is included in the game board of FIG. 1.

Referring to FIG. 7, is shown a flowchart of the basic operation of the microcomputer. Referring also to FIG. 8, is provided a brief written description that outlines the operation of the microcomputer and the electrical control circuit 14.

The disclosure provides one configuration for the circuit puzzle 10. It is understood that other variations in the design of the electrical control circuit 14 and the programming of the microcomputer are possible for the circuit puzzle 10. Additional details of operation and capabilities of the electrical control circuit 14 are included in the brief descriptions provided in FIG. 8.

A broad overview of the operation of the electrical control circuit 14 follows. The electrical control circuit 14 is included in the game board 12 beneath the planar surface 16. Two coils (L1 and L2 as shown in FIG. 9) are strategically placed under the planar surface 16 and energized so that an electromagnetic field is generated when the power switch 98 is in the "ON" position. The electromagnetic field affects all possible locations on the active area of the planar surface 16 where any of the game pieces 18 may be placed.

Accordingly, during use, the electromagnetic field that is produced by the electrical control circuit 14 that extends above the planar surface 16 and is experienced by every game piece 20-34 that is placed on the active area of the planar surface 16.

Prior to completion of the electrical circuit 38 (i.e., as long as one or more game pieces 20-34 are missing) no current will flow through any of the game pieces 20-34 because there is no electrical circuit 38 in existence on the planar surface 16. However, when the electrical circuit 38 is completed by the user properly inserting the final game piece 20-34 in the proper position on the planar surface 16 and thereby completing the electrical circuit 38, an induced current flow is experienced by the electrical circuit 38.

The current flow occurs because the electrical circuit 38, when complete, is an actual electrical circuit that extends in a continuous loop. Electrical continuity between all of the conductors 36 completes the electrical circuit 38 that is disposed on the planar surface 16. A small induced electric current flows through the electric circuit 38 but only when the electric circuit 38 is complete. Prior to completion there is no current flow.

A more detailed discussion about the electrical control circuit 14 follows and can best be understood by frequent referral to the schematic of FIG. 9.

A processor (U1) produces a precise square wave which drives a resonant circuit, comprised of capacitors C1,C2 and a first coil (inductor) L1, through a current limiting resistor R7.

The first coil L1 is loosely magnetically coupled to a second coil L2. The second coil L2 forms a resonant circuit with capacitor C8. The current in the first coil L1 induces an alternating voltage in the circuit L2-C8.

A resistor R18 and capacitor C9 form a low pass filter to limit the influence of nearby radio transmissions such as mobile phones and wireless networks.

A detector circuit D1, R9 and C3 create a low frequency signal proportional to the average value of the peak voltage in the resonant circuit L2-C8 over an interval determined by the time constant of R9 and C3.

An amplifier stage (¼ LM2902, R10 and R11) amplifies and reduces the impedance of the output of the detector stage (circuit).

When the puzzle is solved the game pieces 18 form a conductive short circuit in the magnetic field of L1. This additional load causes the voltage in the detector circuit and consequently the output of the amplifier to decrease.

If the voltage at an edge detector R12,R13,C4 decreases by a fraction greater than R12/R3 in a short time compared to the time constant defined by R13 and C4, the open loop amplifier stage output goes high signaling the processor U1 that the game has been solved (i.e., that the final piece 20-34 necessary to complete the electrical circuit 38 has just been properly placed on the planar surface 16 thereby completing the puzzle).

The combination of R13 and C4 forms a floating reference voltage which can adjust to slow changes in the output of the detector such as those caused by decay of the supply voltage due to discharge of the batteries.

When the processor U1 detects the game solved signal it enters the win sequence program which flashes the LED's (1-6) and outputs the music to be played through the speaker.

The induced voltage and induced current flow in the electrical circuit 38 is too small to present a hazard or to be of any concern to the user. It is not even detectable by the user. However, an added benefit that is provided by the design is that current flows in the electrical circuit 38 atop the planar surface 16 only when the electrical circuit 38 is complete (i.e., only after all eight of the game pieces 20-34 are properly installed on the planar surface 16). When they are all installed, contact by the user with any of the loops 50, 52 or with any of the electrical conductors 36 is prevented by the electrically insulating exterior of each of the game pieces 18. This ensures that there is no way that a user can experience any induced voltage or current flow by making direct electrical contact with any of the game pieces 18.

The moment the final (last) game piece 20-34 is inserted and the electrical circuit 38 is formed, the electrical control circuit 14 senses the effect of the induced current in the electrical circuit 38. The induced current flow that is detected by the electrical control circuit 14 is used as a trigger event to indicate to a user the successful completion of the puzzle by assembly of all of game pieces 18 to complete the electrical circuit 38.

Upon completion, the electrical control circuit 14 simultaneously activates for a predetermined period of time the audible indication which is produced by the speaker and heard through the small openings 102 and the visual indication as a triumphant indication to the user that he or she has successfully completed the puzzle.

It requires thought, care, and experimentation to properly assemble all eight game pieces 20-34 and successfully complete the circuit 38 (i.e., the loop). The user is rewarded for his or her effort by the one-time audible indication and the one-time visual indication that occurs upon completion of the electrical circuit 38.

A plurality of light-emitting diode (LED) lights are disposed under the planar surface 16. The LED lights are included in the electrical control circuit 14. During activation, the LED lights are intermittently turned on and off in unison (or in any desired pattern) to provide the visual indication.

A portion of the light emanated by the LED lights passes through the planar surface 16 and also through the translucent game pieces 18 as the visual indication. The light passing through the translucent game pieces 18 increases the visual impact of the visual indication. A desired excerpt from a song, tune, melody or musical composition is played through the speaker that is included with the electrical control circuit 14 to provide the audible indication concurrent with the flashing LEDS lights. A reflective layer is disposed under the LEDS in the game board 12 and is used to increase an amount of light that is emanated through the planar surface 16.

FIGS. 7, 8, and 9, when viewed in combination with reference to the instant specification provide sufficient information to enable a person possessing ordinary skill in the electronic and microcomputer arts (i.e., a qualified engineer or engineers) to fully understand the intent and operation of the circuit puzzle 10.

The use of a total of eight of the game pieces 18 is preferred as it provides a generally good range of difficulty although it is to be understood that either more or less than eight game pieces 18 are possible. Similarly, the active area of the game board 12 can be decreased to include fewer possible game piece 18 placements in order to provide a simpler version of the circuit puzzle 10 or, conversely, the active area of the game board 12 can be increased to include an increased number of possible game piece 18 placements in order to provide a more challenging version of the circuit puzzle 10.

It is of course possible to eliminate the battery or batteries in the game board 12 and to provide a transformer and electrical connection of the transformer to the game board 12 and to a conventional 120 VAC electrical power source, if desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A circuit puzzle, comprising:

(a) a game board that includes a planar surface;

(b) a plurality of game pieces that each include a distinct curvature and shape and an electrical conductor that extends along a longitudinal length of each of said plurality of game pieces, and wherein during use all of said plurality of game pieces are individually placed on said planar surface in a desired orientation with respect to each other;

wherein said electrical conductor of each of said plurality of game pieces includes a first conductor end and an opposite second conductor end;

wherein after all of said plurality of game pieces are placed on said planar surface in said desired orientation with respect to each other, said first conductor end of each of said plurality of game pieces is in contact with and is electrically connected to said second conductor end of a remaining one of said plurality of game pieces and wherein, after placement of a final of said plurality of game pieces in said desired orientation, said electrical conductors of all of said plurality of game pieces electrically connect together in series to create a closed electrical circuit on said planar surface as the object and solution of the circuit puzzle, and wherein said closed electrical circuit forms a continuous loop that is disposed entirely on top of said planar surface, and wherein said continuous loop is not electrically connected by any electrical conductor to any remaining portion of said circuit puzzle or to a power supply; and (c) an electrical control circuit that includes a microcomputer, wherein said electrical control circuit produces an electromagnetic field that radiates above said planar surface; and wherein said electrical control circuit is able to detect an induced current flow in said continuous loop from said electromagnetic field that occurs when a said final of said plurality of game pieces is properly placed on said planar surface to complete said continuous loop, and wherein said electrical control circuit, in response to detecting an occurrence of said induced current flow in said continuous loop on said planar surface, activates an audible indication or a visual indication or an audible and a visual indication for a period of time to indicate completion of said continuous loop;

(g) wherein all of said plurality of game pieces are included in the formation of said continuous loop; and wherein said desired orientation of all of said plurality of game pieces includes a first solution of the circuit puzzle, and wherein said first solution includes a first placement of all of said plurality of game pieces on said planar surface; and wherein said desired orientation includes a second solution of the circuit puzzle, and wherein said second solution includes a second placement of all of said plurality of game pieces on said planar surface; and wherein said second placement is different than said first placement; and wherein said current flow occurs through all of said plurality of game pieces of said continuous loop when all of said plurality of game pieces have been placed on said planar surface sufficient to complete said continuous loop, and wherein no current flow occurs through any of said plurality of game pieces when any of said plurality of game pieces are missing and said continuous loop has not been formed on said planar surface.

2. The circuit puzzle of claim 1 wherein said electrical conductor includes at least a first loop that extends at least partially through a first opening provided at a first end of each of said game pieces and a second loop that extends at least partially through a second opening provided at an opposite second end of each of said game pieces.

3. The circuit puzzle of claim 1 including a constriction that is provided in each of said game pieces along said longitudinal length, and wherein said electrical conductor is disposed in said constriction, and wherein said constriction frictionally engages with said electrical conductor an amount sufficient to retain said electrical conductor in position relative to said constriction.

4. The circuit puzzle of claim 2 wherein each of said game pieces includes a first void disposed in an interior of each of said game pieces proximate said first end and a second void disposed in said interior of each of said game pieces proximate said second end, and wherein when a sufficient force is applied to said first loop a portion of said first loop is urged into said first opening, and wherein when a sufficient force is applied to said second loop a portion of said second loop is urged into said second opening.

5. The circuit puzzle of claim 4 wherein when said portion of said first loop is urged into said first opening said electrical conductor pivots about a first end of said constriction in said first void.

6. The circuit puzzle of claim 4 wherein when said portion of said second loop is urged into said second opening said electrical conductor pivots about a second end of said constriction in said second void.

7. The circuit puzzle of claim 2 wherein said first loop includes at least one loop of said electrical conductor and wherein said second loop includes at least one loop of said electrical conductor.

8. The circuit puzzle of claim 1 wherein said electrical conductor includes a spring-like quality, thereto.

9. The circuit puzzle of claim 1 including a plurality of cylindrically shaped protrusions that extend upward from said planar surface and wherein said cylindrically shaped protrusions help prevent excessive movement of any of said game pieces when any of said game pieces are placed on said planar surface and proximate any of said cylindrically shaped protrusions.

10. The circuit puzzle of claim 1 including a plurality of semi-cylindrically shaped protrusions that extend upward from said planar surface along a raised perimeter of said planar surface, and wherein said semi-cylindrically shaped protrusions help prevent excessive movement of any of said game pieces when any of said game pieces are placed on said planar surface and proximate any of said semi-cylindrically shaped protrusions.

11. The circuit puzzle of claim 1 including a first template for placement on said planar surface, and for placement of said plurality of game pieces on said first template, and wherein said first template includes a first visual indication as to a location to place at least one of said game pieces thereon, and wherein when said first template is utilized along with proper placement of all of said remaining game pieces consistent with said first visual indication sufficient to form said closed electrical circuit on said planar surface, said first solution of the circuit puzzle is achieved.

12. The circuit puzzle of claim 1 including a second template for placement on said planar surface, and for placement of said plurality of game pieces on said second template, and wherein said second template includes a second visual indication as to a location to place at least one of said game pieces thereon, and wherein said second visual indication is different than said first visual location and wherein when said second template is utilized along with proper placement of all of said remaining game pieces consistent with said second visual indication sufficient to form said closed electrical circuit on said planar surface, said second solution of the circuit puzzle is achieved.

13. The circuit puzzle of claim 12 including a solution sheet for said second template, and wherein said solution sheet for said second template includes a complete visual indication as to where every one of said plurality of game pieces is placed on said planar surface to provide said second solution to the circuit puzzle.

14. The circuit puzzle of claim 11 including a solution sheet for said first template, and wherein said solution sheet includes a complete visual indication as to where every one of said plurality of game pieces is placed on said planar surface to provide said first solution to the circuit puzzle.

15. The circuit puzzle of claim 1 including at least one light source that is disposed under said planar surface, and wherein said planar surface is sufficiently translucent to allow at least some of a light from said at least one light source to pass through said planar surface when said at least one light source is illuminated, and wherein said at least one light source is used to provide said visual indication for said period of time to indicate completion of said continuous loop.

16. The circuit puzzle of claim 15 wherein said game pieces are sufficiently translucent to allow at least some of said light from said at least one light source to pass through said game pieces when said at least one light source is illuminated.

17. The circuit puzzle of claim 1 including an electrical connector attached thereto and an electrical cord that includes a corresponding electrical connector at a first end of said electrical cord, and wherein said corresponding electrical connector is attachable and detachable with respect to said electrical connector, and wherein an opposite second end of said electrical cord includes a momentary electrical switch, and wherein when an on-off switch of the circuit puzzle is disposed in an on position and when at least one battery or other source of electrical power is operatively connected to the circuit puzzle and when said corresponding electrical connector is properly attached to said electrical connector, an actuation of said momentary electrical switch is sensed by said electrical control circuit and is used to energize, for a period of time, said audible indication or said visual indication or said audible indication and said visual indication regardless of a position occupied by any of said game pieces on said planar surface and regardless of whether said electrical circuit on said planar surface is complete or not.

* * * * *